United States Patent [19]

Hirai et al.

[11] Patent Number: 4,943,754

[45] Date of Patent: Jul. 24, 1990

[54] COLOR PICTURE TUBE WITH FLAT APPEARING FACE PLATE

[75] Inventors: Ryoji Hirai; Mitsuru Yoshizawa; Hiroyuki Ikeda, all of Mobara, Japan

[73] Assignee: Hitachi, Ltd., Tokyo, Japan

[21] Appl. No.: 277,946

[22] Filed: Nov. 30, 1988

[30] Foreign Application Priority Data

Dec. 2, 1987 [JP] Japan ..... 62-303105

[51] Int. Cl.[5] ..... H01J 31/00

[52] U.S. Cl. ..... 313/477 R; 313/408

[58] Field of Search ..... 313/477 R, 461, 408; 220/2.1 A; 313/408

[56] References Cited

U.S. PATENT DOCUMENTS

Re. 27,259 12/1971 Rublack ..... 313/408
2,728,012 12/1955 Swedlund ..... 313/477 R
4,623,818 11/1986 Yamazaki ..... 313/408

FOREIGN PATENT DOCUMENTS 108246 6/1984 Japan ..... 313/477 R
2136198 12/1984 United Kingdom .
2136200 12/1984 United Kingdom .
2147142 5/1985 United Kingdom .

*Primary Examiner*—Donald J. Yusko
*Assistant Examiner*—Michael Horabik
*Attorney, Agent, or Firm*—Antonelli, Terry, Stout & Kraus

[57] ABSTRACT

A rectangular faceplate panel of a color picture tube of the shadow mask type. In the periphery of the rectangular faceplate panel, a curvature $C_{PL}$ at a long side peripheral portion is made larger than a curvature $C_{PS}$ at a short side peripheral portion by a value within a range of from 10% to 100%. Further, a level difference z of a diagonal axis of the rectangular faceplate panel is selected to be large and an average radius of curvature in the diagonal direction of the rectangular faceplate panel is selected to be small. Thus, in the color picture tube of the shadow mask type, the faceplate of can be made to look flat, the doming phenomenon can be improved, and sufficient mechanical strength of the glass envelope can be obtained.

2 Claims, 6 Drawing Sheets

COLOR PICTURE TUBE WITH FLAT APPEARING FACE PLATE

CROSS-REFERENCE OF RELATED PATENT APPLICATIONS

The present application relates to U.S. patent application Ser. No. 158,705 entitled "COLOR PICTURE TUBE OF SHADOW MASK TYPE" filed on Feb. 22, 1988 in the name of Ryoji Hirai et al.

BACKGROUND OF THE INVENTION

The present invention generally relates to a color image receiving tube or picture tube of the shadow mask type, and particularly relates to the structure of a faceplate panel of the picture tube.

Referring to FIG. 1 of the accompanying drawings, a color picture tube of the shadow mask type has a glass envelope 4 constituted by a rectangular faceplate panel 1, a tubular neck portion 2 and a funnel-like portion 3 for connecting the faceplate panel 1 to the neck portion 2. On the other hand, the faceplate panel 1 is composed of a display faceplate 1*a* and an outer peripheral flange or side wall portion 1*b* hermetically bonded to the funnel-like portion 3 at a junction 5 therebetween through low melting point glass. A tricolor phosphor screen 6 is formed over the inner surface of the faceplate panel 1*a*.

A shadow mask 7 is provided inside the faceplate panel 1 at a predetermined interval from the phosphor screen 6. An electron gun assembly 8 is provided within the neck portion 2 in an in-line or delta array so that three electron beams 9 emitted from the electron gun assembly 8 are directed toward the phosphor screen 6 through the shadow mask 7. An external magnetic deflection yoke 10 is provided in the vicinity of the outer circumference of a junction between the neck portion 2 and the funnel-like portion 3. Magnetic flux is caused to act on the electron beams 9 horizontally as well as vertically by means of the yoke 10 so that the screen 6 is scanned with the electron beams 9 in the horizontal direction, that is, along the major axis X-X and in the vertical direction, that is, along the minor axis Y-Y so that a rectangular raster is generated on the screen 6.

Heretofore, generally, the surface configuration of the faceplate panel 1 has been made spherical or cylindrical. Attempts to form the panel surface as flat as possible have encountered various problems. First, a difficulty arises in assuring sufficient mechanical strength of the envelope 4. Additionally, in the shadow mask type color picture tube, a so-called doming phenomenon, that is, local dislocation or shift in color and hence deterioration in color purity, may be caused by thermal expansion of the shadow mask 7 due to impinging-irradiation thereon with the electron beams 9. More specifically, when a given region of the shadow mask is heated to a higher temperature than the other, a spherical bulging takes place in the given region, whereby the mask holes formed in that region are positionally displaced so that the relative position between the electron beams and the phosphor dots are correspondingly varied and thus the local color dislocation (color purity shift) is visually observed. This is the phenomenon referred to as "doming".

For providing a better understanding of the invention, preparatory analysis will be made in some detail on the doming phenomenon by referring to FIGS. 2 to 4 and FIGS. 5A and 5B of the accompanying drawings, in which FIG. 2 is a front view of the faceplate panel of the picture tube shown in FIG. 1, FIG. 3 is a fragmentary sectional view of the picture tube taken along the line X-X in FIG. 2, FIG. 4 is an enlarged fragmentary view of the faceplate and the shadow mask in a portion indicated as enclosed by a circle 12 in FIG. 3, and FIGS. 5A and 5B are enlarged fragmentary views showing in section the screen in two different states, respectively.

As will be described hereunder, the doming phenomenon has a tendency that the more a shadow mask 7 is made to approximate to a flat plane the more the doming phenomenon becomes remarkable, while the larger the curvature of the shadow mask 7 is made the less the doming phenomenon becomes remarkable. The curved contour (curvature) of the shadow mask 7 substantially similarly agrees with that of the inner surface of a faceplate 1*a*.

In the case where a spherical faceplate panel 1 is used, the inner surface thereof presents a substantially spherical contour. In conformance with the spherical inner surface of the faceplate panel 1, the shadow mask 7 attached onto the inside of the faceplate panel 1 also assumes a substantially spherical contour. As the surface profile or contour of the faceplate 1*a* is made to approximate to a flat plane, the spherical contour of the shadow mask 7 becomes straightened approximately to a flat plane so that there is angular deviation between the direction normal to a plane of the shadow mask and the direction in which the electron beams 9 travel. In other words, the angle of incidence at which the electron beams 9 land on the shadow mask becomes large. As the temperature of the shadow mask 7 is increased due to impinging-irradiation with the electron beams, the shadow mask 7 is thermally expanded so that the shadow mask 7 is displaced in the direction normal to the plane of the shadow mask 7, as indicated by an arrow 14 in FIG. 4, from the position 7 indicated by a solid line to the position 7' indicated by a broken line in FIGS. 3 and 4. Correspondingly, the positions of the respective holes formed in the shadow mask 7 are also displaced substantially in the direction normal to the shadow mask 7. At that time, an angular difference $\alpha$ is generated between the beam running direction 16 and the direction 14 in which the shadow mask 7 is displaced, as is illustrated in FIG. 4. Consequently, the path of the electron beams 9 passing through the same hole in the shadow mask 7 varies in such a manner as indicated by a broken line 9' as the shadow mask 7 is thermally expanded. The above variation in the path of the electron beams is visually observed as the dislocation of color (purity shift of color). More specifically, in the state in which no doming phenomenon takes place, the electron beam 9 can land on a center region between black matrix stripes 18, as shown in FIG. 5A, whereas it lands on at a position deviated from the center between the black matrix stripes, as indicated by 9' in FIG. 5B, upon occurrence of the doming phenomenon, thus resulting in the color dislocation.

The magnitude of a change in the relative position between the electron beam and the phosphor dot caused by the doming phenomenon, that is, the magnitude D of the doming, can be calculated in accordance with the following expression (1):

$$D \approx d \cdot \tan \alpha \, x \, \frac{(p_r + q_r)}{p_r} \qquad (1)$$

where d represents the change in position of the hole of the shadow mask 7 in the direction normal thereto due to the thermal expansion of the shadow mask 7, $\alpha$ represents the angle of incidence of the electron beam 9 to the shadow mask 7, $p_r$ represents the distance between the center of a deflection plane and the shadow mask 7 as measured along the direction of the beam path, and $q_r$ represents the distance between the shadow mask 7 and the phosphor screen as measured along the beam path, as is illustrated in FIG. 3.

In the case where the curved surface of the shadow mask 7 is of a simple spherical contour, the aforementioned incident angle $\alpha$ can be calculated in accordance with the following expression (2):

$$\alpha = \cos^{-1}\frac{p_o}{R} - \cos^{-1}\frac{p_o}{p_r} \quad (2)$$

where R represents the radius of curvature of the spherical surface of the shadow mask 7, and $p_o$ represents the distance between the center of deflection and the center of the shadow mask 7 on the major axis.

For example, in a conventional 21V" (90° ) color picture tube, the radius of curvature R is about 840 mm, $p_o$ is about 281.15 mm, and $p_r$ is about 306.7 mm when measured at a point on the shadow mask distanced from the center thereof by 150 mm. Accordingly, the angle $\alpha$ is about 47.0° .

If the radius of curvature R is increased to about 1680 mm in order to flatten the spherically curved contour of the shadow mask in the color picture tube mentioned above, then $p_o$=281.5 mm and $p_r$=313.1 mm. Accordingly, $\alpha$=54.4° .

Thus, when the faceplate panel is flattened (by doubling the radius of curvature) as described above, the magnitude of the doming is increased by a factor of about 1.3, as calculated by the inventors of this application in accordance with the aforementioned expression (1) on the assumption that the change of the hole position in the shadow mask is constant. However, the results of computer-aided analysis based on the so-called finite element method show that the magnitude of the doming is increased at least by a factor of 2 when the radius of curvature R is doubled. It has been found that the value resulting from the computer-aided analysis approximately coincides with the data obtained from the measurement conducted by the inventors for a prototype tube manufactured for this purpose.

As will be appreciated from the foregoing, limitation is imposed on the attempt for flattening the surface contour of the faceplate panel because of the doming phenomenon. Put another way, diminishing in the radius of curvature of the shadow mask which is effective for remedying the doming is in contradiction to the flattening of the faceplate panel.

FIG. 6 is an explanatory diagram obtained by superimposing the respective outer contours of the sections of the conventional spherical faceplate panel 1 along the minor axis 13, the major axis 15 and the diagonal axis 17 representing the Y-Y axis, the X-X axis and the diagonal line W-W respectively in FIG. 2. The reference numeral 19 represents the center of the faceplate panel 1.

Recently, color picture tubes in which the radius of curvature of faceplates are made small to give audiences a flat feeling have been popularized. As the radius of curvature of the faceplate 1*a* is made small, however, the radius of curvature of the shadow mask 7 disposed in opposition to the faceplate 1*a* is inevitably made small correspondingly. Accordingly, the deterioration in color purity becomes a problem as described above.

Here, referring to FIG. 7, description is made by use of an average radius of curvature $R_a$ in the diagonal direction as an index representing the flatness of a faceplate 1*a*. In a spherical faceplate 1*a*, generally, the quantity of displacement in beam landing on the phosphor screen due to the doming phenomenon is proportional to the average, radius of curvature $R_a$ in the diagonal direction. FIG. 8 is a graph showing the relationship between the average radius of curvature $R_a$ in the diagonal direction and the quantity of displacement (relative value) in beam landing due to the doming in a 31"-screen color picture tube. Further, it has been known that the strength against pressure of the glass envelope 4 is reduced in inverse proportion to the average radius of curvature $R_a$ in the diagonal direction. FIG. 9 is a graph showing the relationship between the average radius of curvature $R_a$ in the diagonal direction and the maximum stress (stress due to vacuum transformation strain) at the junction 5 between the faceplate panel 1 and the funnel-like portion 3 in a 31"-screen color picture tube.

Accordingly, in order to flatten the faceplate 1*a*, the technical countermeasure against the doming phenomenon and the strengthening of the glass envelope 4 become required. In order to attempt to reduce the doming phenomenon and to strengthen the glass envelope 4, it is effective to reduce the average radius of curvature $R_a$ in the diagonal direction as shown in FIGS. 8 and 9. However, this countermeasure is contrary to the flattening of the faceplate 1*a*.

As the picture tube known heretofore in which attempt is made to make the flattening of the faceplate compatible with reduction of the doming phenomenon, known is that disclosed in GB No. 2136200A, GB No. 2136198A, GB No. 2147142A and U.S. Pat. No. 4,623,818. In this case, the surface contour of the faceplate panel along the minor axis is established so as to be represented by a quadratic expression, while the curvature in the center portion of the faceplate panel along the minor axis is selected to be greater than the curvature along the major axis.

FIGS. 10, 11, and 12 of the accompanying drawings show sections of part of the known faceplate panel described above, which sections are taken along the minor axis X-X, the major axis Y-Y and the diagonal axis W-W in FIG. 2. In these figures, P represents the height of the peripheral wall portion of the panel. In this conventional case, a region where the derivative of second order of the curvature along the diagonal assumes minus sign is provided, that is, an inflexion point 20 is provided (FIG. 12), in order to flatten the corner surface regions of the faceplate.

In the above conventional case, there are undesirable problems in the following points which become a trouble in practical application.

(1) First, reflection of ambient light on the surface of the faceplate panel 1 presents a problem although it depends on the design of the curved surface contour of the faceplate 1. More specifically, because of the presence of the inflexion points in the corner regions of the faceplate panel 1, the ambient light reflected on the faceplate panel 1 is bent in the vicinity of those inflexion points. For example, when a lattice pattern of ambient light is reflected on the faceplate panel 1, the pattern will be distorted in the corner peripheries in such a manner as illustrated in FIG. 13 to provide discomfort in visual sense. FIG. 13 shows a quarter part of the faceplate panel 1.

(2) Next, as the area of the region where the derivative of second order of the curvature along the diagonal line assumes minus sign (adjacent to the inflexion point 20) is increased, the mechanical strength of the shadow mask is reduced and becomes more susceptible to thermal deformation.

(3) Lastly, in view of the fact that there exists a correlation between the doming phenomenon and the contour of the boundary portion defining the effective picture area of the faceplate panel, a difficulty will be encountered in remedying the doming phenomenon.

In other words, if the effective picture area defining boundary portion (in the vicinity of the inflexion point 20 in FIG. 12) is flattened so that the faceplate may look flat, there arises another problem that the doming phenomenon is more likely to take place.

SUMMARY OF THE INVENTION

It is therefore an object of the present invention to solve the above technical problems in the prior art and to provide a color picture tube of the shadow mask type provided with a faceplate panel in which a faceplate is made to look flat, the doming phenomenon can be reduced, a glass envelope can be strengthened.

It is another object of the present invention to provide a color picture tube of the shadow mask type in which the average radius of curvature in the diagonal direction of the faceplate panel is suppressed to a small value so as to make the faceplate flat in the outward appearance.

The above objects can be attained by forming the faceplate panel so that in the peripheral portion of the faceplate, the curvature of the long side peripheral portion is made to be larger than that of the short side peripheral portion by a value within a range of from 10% to 100%.

As has been actually proved with respect to a cylindrical faceplate, the feeling of flatness of the faceplate sensed by an audience owes more to the curvature of the short side peripheral portion than that of the long side peripheral portion. Since the curvature of the long side peripheral portion is made larger than that of the short side peripheral portion in the faceplate according to the present invention, it is possible to obtain a flat faceplate panel by making large the respective curvatures of the long and short side peripheral portions, without much changing the average radius of curvature in the diagonal direction compared with the conventional one, even if the curvature of the short side peripheral portion which greatly contributes to give an audience a feeling of flatness of the faceplate is made small. Further, since the radius of curvature in the diagonal direction becomes not so large, it is possible to prevent the reduction in mechanical strength of the glass envelope.

BRIEF DESCRIPTION OF THE DRAWINGS

Preferred embodiments of the present invention will now be described in conjunction with the accompanying drawings, in which.

DESCRIPTION OF THE PREFERRED EMBODIMENTS

Figure 1:
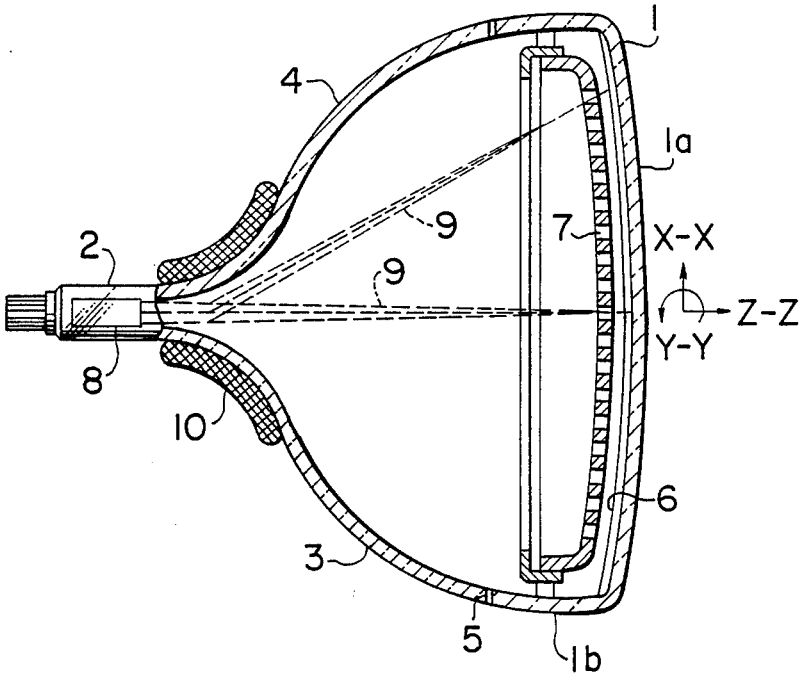
FIG. 1 is a sectional view of a color picture tube of the shadow mask type.
Figure 2:
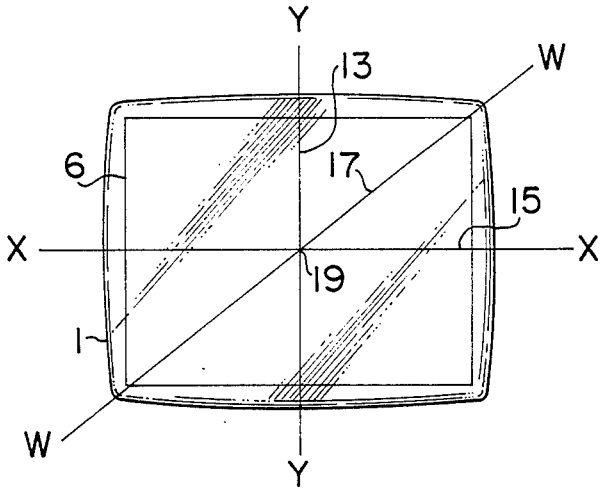
FIG. 2 is a front view of a faceplate panel of the color picture tube of FIG. 1.
Figure 3:
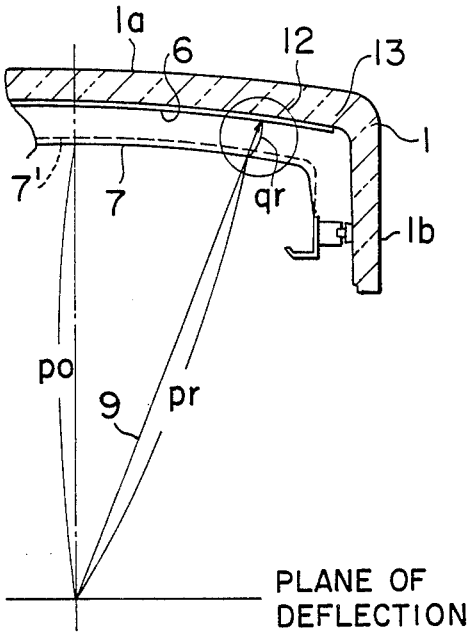
FIG. 3 is an enlarged sectional view showing a part of the faceplate panel along the line X-X in FIG. 2.
Figure 4:
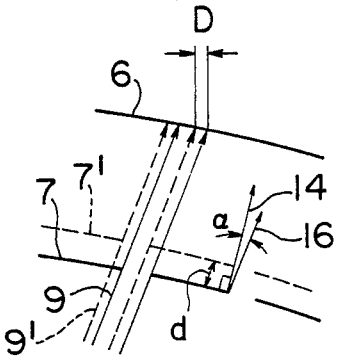
FIG. 4 is an enlarged view showing a part of FIG. 3.
Figures 5A, 5B:
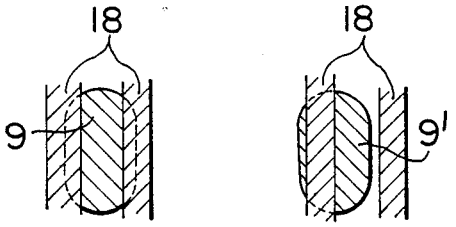
FIGS. 5A and 5B are enlarged views each showing a part of the screen of FIG. 3.
Figure 6:
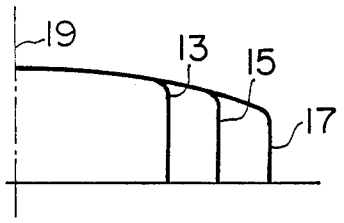
FIG. 6 PRIOR ART
FIG. 6 is an explanatory diagram obtained by superimposing the respective outer contours of the sections of the conventional faceplate panel along the minor axis, the major axis, and the diagonal axis.
Figure 14:
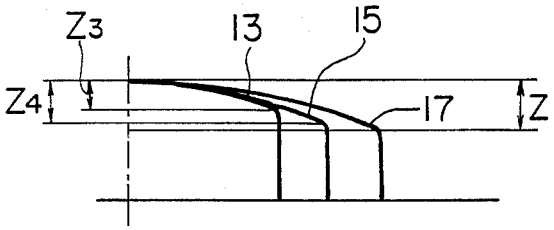
FIG. 14 is an explanatory diagram obtained by superimposing the respective outer contours of the sections of the faceplate panel along the minor axis, the major axis, and the diagonal axis in an embodiment of the faceplate panel according to the present invention.
Figure 15:
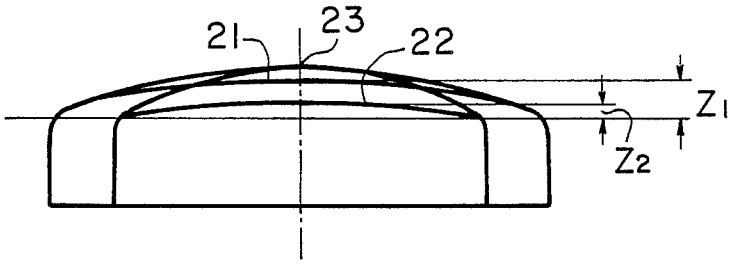
FIG. 15 is an explanatory diagram obtained by superimposing the side views of the faceplate panel of FIG. 14 viewed from the long and short sides of the faceplate panel respectively.

Referring now to FIGS. 14 and 15, an embodiment of the present invention will be described hereunder. FIG. 14 is an explanatory diagram obtained by superimposing the respective outer contours of the sections of the faceplate panel along the minor axis 13, the major axis 15, and the diagonal axis 17 in the faceplate panel 1 of FIG. 2, and FIG. 15 is an explanatory diagram obtained by superimposing the side views of the faceplate panel 1 viewed from the long and short sides of the faceplate panel 1 respectively. In the faceplate panel 1, the curvature $C_{PL}$ at a long side peripheral portion 21 and the curvature $C_{PS}$ at a short side peripheral portion 22 are different from each other, and the curvature $C_{PL}$ at the long side peripheral portion 21 is established so as to be larger than the curvature $C_{PS}$ at the short side peripheral portion 22 by a value within a range of from 10% to 100%. The reference numeral 23 represents the central portion of the faceplate panel 1.

Figure 7:
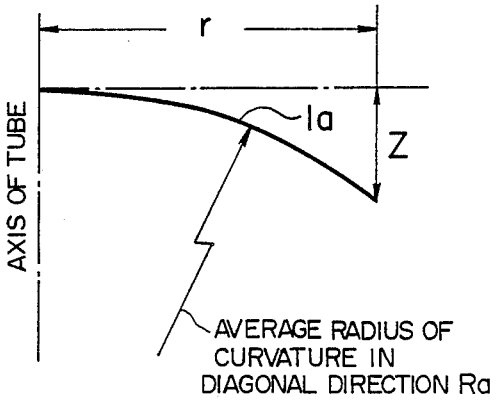
FIG. 7 is a diagram for explaining the average radius of curvature in the diagonal direction of a color picture tube.
Figure 8:
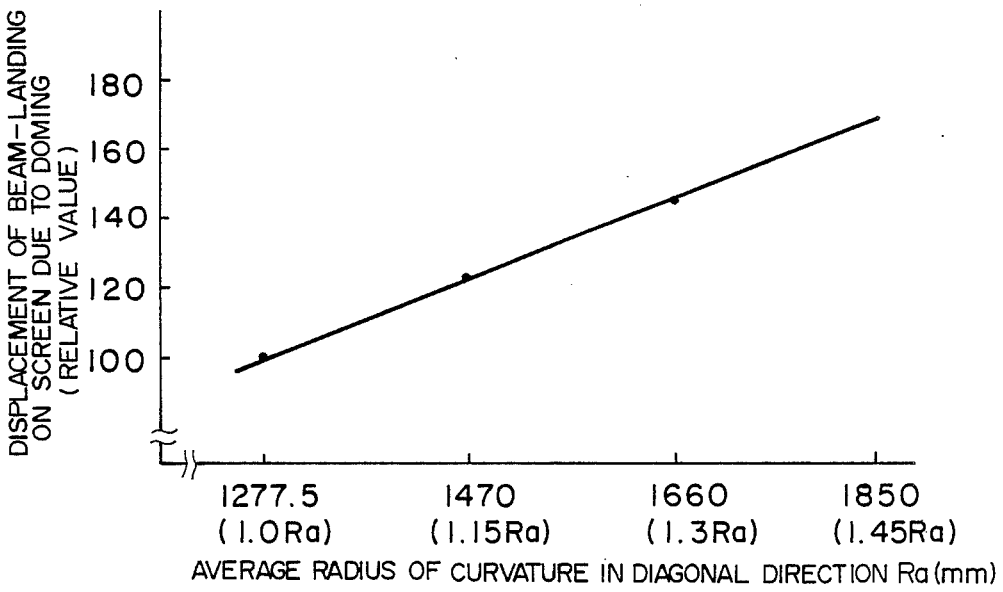
FIG. 8 is a graph showing the relationship between the average radius of curvature in the diagonal direction and the quantity of displacement of beam landing on the screen due to the doming phenomenon in a color picture tube.
Figure 9:
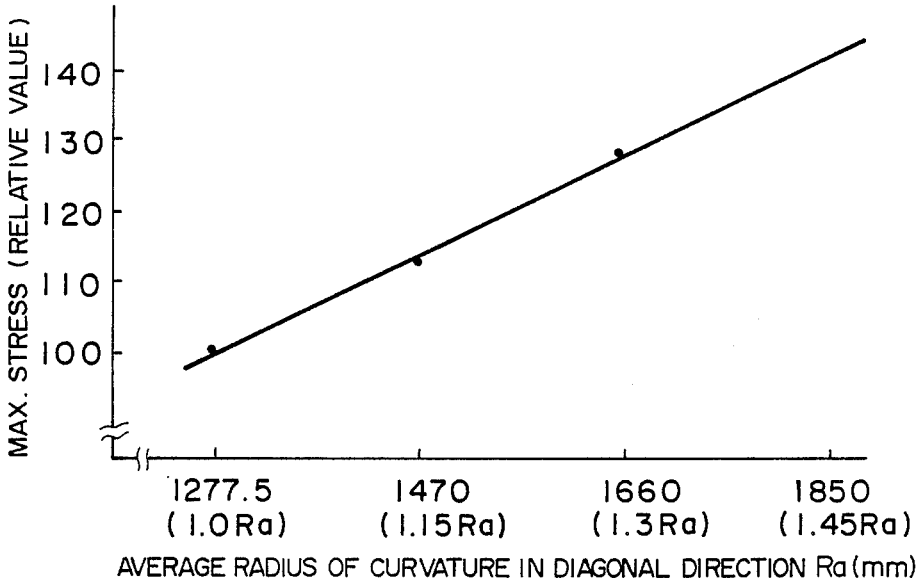
FIG. 9 is a graph showing the relationship between the average radius of curvature in the diagonal direction and the stress in the glass envelope by strain due to atmospheric pressure in a 31"-screen color picture tube.
Figure 10:
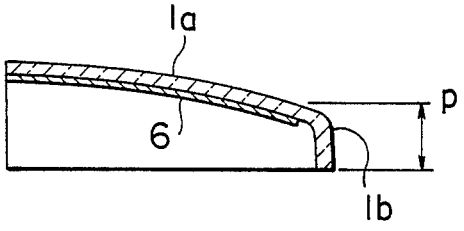
FIG. 10 PRIOR ART
FIGS. 10, 11 and 12 are sectional views showing part of sections of the conventional faceplate panel along the X-X axis, the Y-Y axis and the W-W axis of FIG. 2.
Figure 11:
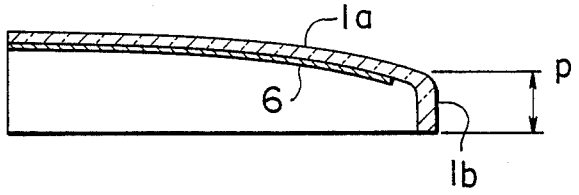
FIG. 11 PRIOR ART
Figure 12:
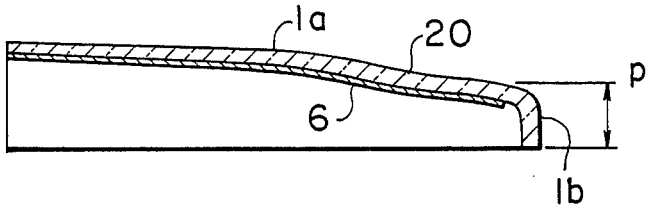
FIG. 12 PRIOR ART
Figure 13:
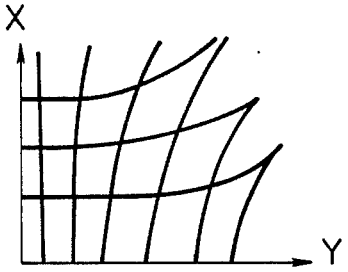
FIG. 13 PRIOR ART
FIG. 13 is a view showing an example of an ambient light reflecting pattern in the conventional faceplate panel.

In FIG. 7, the level difference z of the diagonal axis 17 of the faceplate panel 1 can be obtained from the average radius of curvature $R_a$ in the diagonal direction and the radius r of the faceplate panel 1 in the diagonal direction through the following equation (3):

$$z = R_a - \sqrt{R_a^2 - r^2} \quad (3)$$

Further, in FIG. 14, the level difference z of the diagonal axis 17 at the peripheral portion can be expressed as follows:

$$z = z_1 + z_3 = z_2 + z_4 \ldots \quad (4)$$

In the equation (4):

(i) In order to reduce the doming phenomenon,

① the values of $z_3$ and $z_4$ are made large; and (ii) In order to give the faceplate panel 1 a feeling of flatness, ① the value of z is made small, ② the values of $z_1$ and $z_2$ are made small (the value of z may be large), and ③ the value of $z_2$ is made small (the values of $z_1$ and z may be large)→ the value of $z_1$ is made large→ the value of z is made large (also the values of $z_3$ and $z_4$ become large).

The condition of the item ③ is applied to the present invention. That is, according to the present invention, the level difference z is made large and the value of $z_2$ is made small to thereby give the faceplate panel 1 a feeling of flatness, while the radius of curvature $R_{PL}$ at the long side peripheral portion 21 is made large and the average radius of curvature $R_a$ in the diagonal direction is made small.

Since the curvature $C_{PL}$ of the long side peripheral portion 21 is made larger than the curvature $C_{PS}$ of the short side peripheral portion 22 by a value within a range of from 10% to 100% as described above, it is possible to obtain a flat faceplate panel 1 by making large the curvature $C_{PL}$ along the long side peripheral portion 21 and the curvature $C_{PS}$ along the short side peripheral portion 22, without much changing the average radius of curvature $R_a$ in the diagonal direction compared with the conventional one even if the curvature $C_{PS}$ of the short side peripheral portion 22 which greatly contributes to give an audience a feeling of flatness of the faceplate 1 is made small. Here, if only the curvature $C_{PS}$ of the short side peripheral portion 22 is made large to maintain the average radius of curvature $R_a$ in the diagonal direction, the radius of curvature along the minor axis 13 becomes so small relative to the value of the faceplate panel that the shape becomes unnatural. Thus, the non-sphericity becomes remarkable so that the distortion in outer face reflexion image becomes an undesirable problem. In the embodiment, however, the average radius of curvature $R_a$ in the diagonal direction can be suppressed to a small value so that the reduction of the mechanical strength of the glass envelope 4 is prevented.

Figure 16:
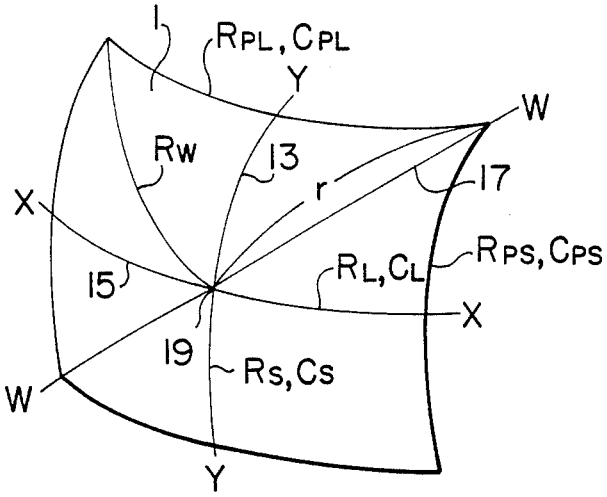
FIG. 16 is a perspective view of an embodiment of the faceplate panel according to the present invention.

Specifically, the average 1*d* $R_a$ in the diagonal direction is about 1277.5 mm in an example of a faceplate panel of the conventional 31"-screen color picture tube. On the other hand, in the embodiment of the faceplate panel of a 31"-screen color picture tube according to the present invention shown in FIG. 16, the average radius of curvature $R_a$ in the diagonal direction is about 1470 mm, the average radius of curvature $R_L$ along the major axis 15 is about 1300 mm, the average radius of curvature $R_S$ along the minor axis 13 is about 1275.5 mm, the radius of curvature $R_{PL}$ of the long side peripheral portion 21 is about 1600 mm, and the radius of curvature $R_{PS}$ of the short side peripheral portion 22 is about 1920 mm. Here, the following relation is satisfied:

$$R_S > R_L \times 1.1 \quad \ldots (4)$$

Thus, according to the present invention, it is possible to suppress the average radius of curvature in the diagonal direction to a relatively small value about 1.15 times as large as the conventional one without much changing the conventional value of curvature at any section while maintaining a feeling of flatness (the flatness 1.5 times as flat as the conventional value at the short side peripheral portion).

According to the present invention, it is possible to obtain an excellent effect that the doming phenomenon can be improved and the reduction in mechanical strength of the glass envelope can be prevented, while a feeling of flatness of the faceplate is maintained.

Further, it is possible to further obtain another excellent effect that the thickness of the faceplate panel of a color picture tube of the shadow mask type can be reduced because the average radius of curvature in the diagonal direction of the faceplate panel can be suppressed to a small value.

What is claimed is:

1. A color picture tube of the shadow mask type comprising a rectangular faceplate panel constituted by a rectangular faceplate which has an outward convex central portion, an outer periphery and curvatures $C_L$ and $C_S$ along major and minor axes of said rectangular faceplate, said rectangular faceplate being formed so that at least in the periphery of said rectangular faceplate, a curvature $C_{PL}$ at a long side peripheral portion is made larger than a curvature $C_{PS}$ at a short side peripheral portion by a value within a range of 10% to 100%.

2. A color picture tube of the shadow mask type according to claim 1, wherein said rectangular faceplate panel has a diagonal axis and wherein an average radius of curvature of the rectangular faceplate panel in the direction of the diagonal axis is suppressed and a level difference corresponding to axial distance between a central portion of said rectangular faceplate panel and a peripheral portion of said rectangular faceplate panel on said diagonal axis is maximized in order to make said rectangular faceplate appear to be flat.

* * * * *